US005230427A

United States Patent [19]

Betts et al.

[11] Patent Number: 5,230,427

[45] Date of Patent: Jul. 27, 1993

[54] STERILIZABLE HERMETICALLY-SEALED SUBSTANTIALLY GLASS CONTAINER

[75] Inventors: Ronald E. Betts, La Jolla; Douglas R. Savage, Del Mar; Debra J. Shane, La Jolla, all of Calif.

[73] Assignee: PPG Industries, Inc., Pittsburgh, Pa.

[21] Appl. No.: 713,893

[22] Filed: Jun. 12, 1991

[51] Int. Cl.[5] ..... B65D 81/28

[52] U.S. Cl. ..... 206/213.1; 215/347; 215/349; 215/DIG. 3

[58] Field of Search ..... 206/213.1; 215/317, 215/333, 339, 340, 347, 349, 363, 364, DIG. 3; 422/102

[56] References Cited

U.S. PATENT DOCUMENTS

| | | | |
|---|---|---|---|
| 929,610 | 7/1909 | Lilly | 206/213.1 |
| 1,426,209 | 8/1922 | Newland | 215/317 |
| 1,448,094 | 3/1923 | Sorgan | 215/347 |
| 1,858,864 | 5/1932 | Podel | 215/317 |
| 2,646,183 | 7/1953 | Pellett | 215/347 |
| 3,311,250 | 3/1967 | Lodding et al. | 215/340 |
| 3,323,672 | 6/1967 | Acton | 215/333 |
| 3,330,720 | 7/1967 | Stevens et al. | 215/347 |
| 3,424,329 | 1/1969 | Hershberg et al. | 215/37 |
| 3,552,591 | 1/1971 | Wimmer | 215/37 |
| 3,580,423 | 5/1971 | Gilman | 215/DIG. 3 |
| 3,681,255 | 8/1972 | Wilfore | 262/408 |
| 3,844,275 | 10/1974 | Elliott | 128/2.1 |
| 3,892,058 | 11/1975 | Komatsu | 53/21 FC |
| 3,922,363 | 11/1975 | Mitsuda et al. | 426/410 |
| 4,030,271 | 6/1977 | Kefauver et al. | 53/305 |
| 4,084,588 | 4/1978 | Koenig | 128/218 R |
| 4,116,336 | 9/1978 | Sorensen et al. | 206/524.8 |
| 4,248,355 | 2/1981 | Kolb et al. | 215/274 |
| 4,335,824 | 6/1982 | Bush | 215/317 |
| 4,390,552 | 6/1983 | Niwa | 215/347 |
| 4,403,707 | 9/1983 | Connor | 215/253 |
| 4,442,129 | 4/1984 | Niwa et al. | 426/399 |
| 4,482,070 | 11/1984 | Dubach | 215/317 |
| 4,664,274 | 5/1987 | Konrad | 215/232 |
| 4,684,554 | 8/1987 | Ou-Yang | 215/349 |
| 4,693,385 | 9/1987 | Lamping et al. | 215/232 |
| 4,754,890 | 7/1988 | Ullman et al. | 215/232 |
| 4,773,552 | 9/1988 | Boege et al. | 215/247 |
| 4,778,698 | 10/1988 | Ou-Yang | 215/347 |
| 4,886,495 | 12/1989 | Reynolds | 604/88 |
| 4,930,646 | 6/1990 | Emslander | 215/347 |
| 4,935,273 | 6/1990 | Ou-Yang | 215/347 |
| 4,969,883 | 11/1990 | Gilbert et al. | 604/414 |
| 4,974,735 | 12/1990 | Newell et al. | 215/253 |

OTHER PUBLICATIONS

"Quality Control in Blood pH and Gas Analysis by Use of a Tonometered Bicarbonate Solution and Duplicate Blood Analysis" by Robert W. Burnett, *Journal of Clinical Chemistry*, vol. 27, No. 10, 1981, pp. 1761–1763 (Abstract).

*Primary Examiner*—David T. Fidei
*Attorney, Agent, or Firm*—Kenneth J. Stachel

[57] ABSTRACT

A hermetically sealed vial for liquids is provided by the present invention. The liquid can be a calibrant or a reference fluid for gas analysis where the liquid has dissolved gas or medication or medicaments. The vial is a glass container means with at least one opening. The dimensions of the opening range from that which is just effective for the addition and removal of fluids to that which is the smallest side of the container. A flange circumferentially extends about the opening. The vial has the liquid that does not fill the vial to leave room for a head space. The head space is present in an amount of the volume percent of the vial ranging from 1 to 99 compared to the amount of the liquid. The vial is sealed with an air impermeable bilaminate seal comprised of an adhesive polymer contacting the vial and a metal surface facing externally from the vial. Before the vial is sealed by heat or induction sealing a securing means like a cap or chemical coupling agents are used to hold the seal on the vial. When the cap is a snap cap a gasket can be present between the cap and the seal. The vials can be sterilized and processed as a plurality of vials during heat and induction sealing and optionally sterilization depending on the application.

38 Claims, 3 Drawing Sheets

STERILIZABLE HERMETICALLY-SEALED SUBSTANTIALLY GLASS CONTAINER

The present invention is directed to a sterilizable and substantially hermetically-sealed or substantially airtight container that can contain among other contents a fluid for calibration or for quality control for blood gas measuring equipment.

Small sized containers are used extensively in the medical field in such areas as medicament or "single use" vials for syringe-delivered medications and other types of serum vials and reference fluid containers for the analysis of bodily fluids. One type of container that is traditionally used in these areas is the glass ampule. For example, reference fluids that have a known partial pressure of oxygen and carbon dioxide have been packaged in ampules for use with numerous commercially available measurement instruments. Some of these instruments measure the partial pressure of oxygen and/or the partial pressure of carbon dioxide in various physiological fluids. The reference fluids provide the quality control in measuring the concentration of these gases in the physiological fluids. For example, blood gas analysis involves measuring the partial pressures of these gases in arterial blood samples where the blood is drawn from the patient and transported to the lab for injection into the analyzer.

The use of glass ampules in these areas can be burdensome since the ampules have to be scored and broken to remove the fluid. Such a procedure may cause cuts to the user in scoring and breaking and/or from contacting the jagged edges of the cut glass ampule. In this day and age of minimizing contact with blood samples to avoid infectious disease such a procedure could be improved. Utilizing plastic rather than glass ampules may offer a solution but such a substitution creates another problem. It has been mentioned that plastic bottles with aqueous solutions can result in the loss of the solution upon extended storage. Also, plastic containers can result in a change in nonambient gas values over time for stored tonometered reference fluids. The extent of such a loss can be more than 10 percent of the stored aqueous solution for a two-year storage period and greater than 10 percent of the gas partial pressures in a given time period. Such a loss is unacceptable for medicinal formulations of B.P. or U.S.P. that are made to a percent variation in solution strength of active ingredient of not more than 10 percent. Also, such containers that lack a good hermetic seal may not be adequate for reference and/or calibration fluids in blood gas analysis.

Recently, it has been suggested in U.S. Pat. No. 4,116,336 to have a package of a reference fluid that is a flexible, gas-tight container not having any bubbles in the container. This latter flexible package can be a laminate bag of aluminum foil with an interior layer of heat sealable plastic of low gas permeability and good weldability. The aluminum foil of the package is of sufficient thickness to obviate the danger of pinholes. The heat sealable plastic, for instance a polyacrylonitrile copolymer, allows for sealing by welding of the plastic layer. For this package it is pointed out that the absence of gas bubbles results from the maintenance of a total gas pressure in the liquid of below 600 mm of mercury at 37° C. when the package is being filled. This patent teaches that drastic changes in the data measured on the reference liquid, in particular the partial pressure of oxygen, can occur with less than vigilant guard against the presence or formation of bubbles in the reference liquids enclosed in a gas-tight package.

There is a need in the industry for providing hermeticallysealed containers for medicaments and/or serum vials and for reference fluids in a container where the containers are easier to use than glass ampules and not subject to scratching or pinholes as in a flexible aluminum package and that have good shelf life for the stored reference liquid.

SUMMARY OF THE INVENTION

An aspect of the present invention is a sterilizable hermetically-sealed container that has a fluid containing at least one gas dissolved in liquid that can be useful as standards for quality control or as calibration fluid for fluid measurements like blood gas measurements. The container has a glass container means or vial having an opening at one end, a substantially impervious seal for at least air, a fluid that is a liquid with a known amount of at least one dissolved gas. The amount of the fluid in the container is an amount less than that which would completely fill the container so that a head space exists in the container. The volume percent of the fluid compared to the head space ranges from about 99 to less than around 1. The seal has an inner and outer surface where the outer surface is a substantially non-oxidizing metal such as aluminum and the inner surface is an adhesive-type polymer. The seal is fixedly attached to the glass container to cover the opening in the container. This attachment can be by a chemical means and/or by a mechanical means of cap.

In another aspect of the present invention, the cap is a particular cap that is a plastic snap cap on a glass container having an opening at one end and having the seal. The cap has a skirt that extends over the edge of the glass container. On the inside surface of the skirt there is a fastening member and on the top surface of the glass container there is a counterpart fastening member. These members communicate so the snap cap closes on the glass container in a secure manner to reduce the amount of any component leaving the container. Also the top surface of the cap has an opening at or around the axial center of the top surface where the top surface becomes the skirt which is passed the end of the horizontal or top surface of the glass container. This opening allows alignment with the opening of the glass container for removal of components from the container.

In still another aspect of the present invention, a method is provided for producing the sterilized hermetically-sealed container for containing a liquid for calibration and/or quality control in blood gas measuring devices. The method involves: preparing a tonometered fluid comprised of a liquid and a gas, filling the glass container having at least one opening at one end with the fluid to an extent to be less than completely full, covering the opening of the container with a seal that is substantially impervious to air, securing the seal to the glass container by heat or induction sealing, sterilizing the container, and checking at least one of the sterilized containers for leaks.

BRIEF DESCRIPTION OF THE DRAWINGS

FIG. 2 shows a side cut-away view of the top section of the sealed container. FIG. shows an enlarged exploded view of the top-section of a container that has screw cap without the cut-away view of FIG. 2.

DETAILED DESCRIPTION AND PREFERRED EMBODIMENTS

Figure 1:
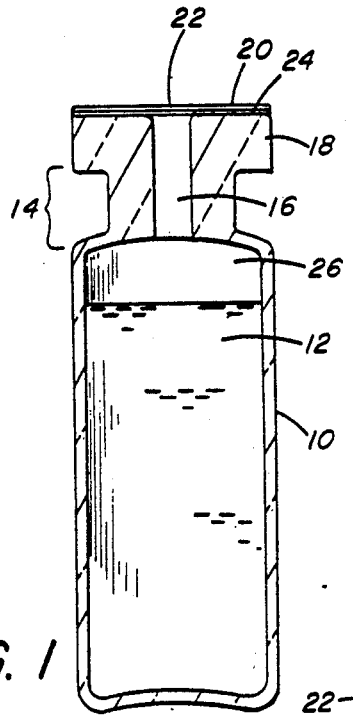
FIG. 1 depicts a somewhat enlarged cross sectional side view of the container of the present invention with the two or bilayer seal attached by chemical means to the glass vial to cover the opening.
Figure 5:
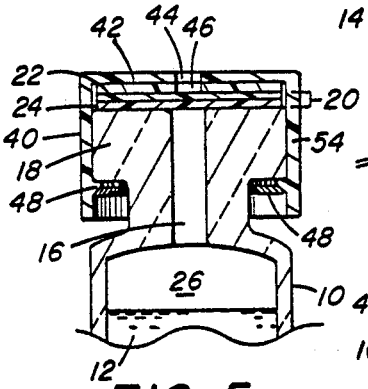
FIGS. 5 and 6 depict somewhat enlarged different cross sectional side views of the top of the vial with a snap cap securing the seal to the glass vial and with and without a gasket, respectively.
Figure 6:
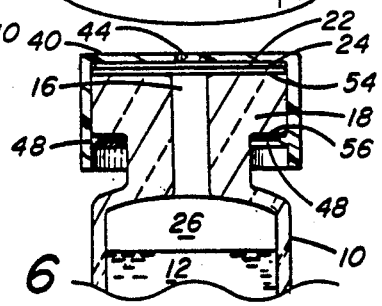

As shown in FIGS. 1, 5 and 6, a fluid can be present in vial 10 where the fluid 12 can be a liquid such as medicaments and materials traditionally supplied in serum vials especially when vial 10 has a snap cap as more fully described in FIGS. 4 through 7, or reference fluid or liquid containing a dispersed gas or a combination of liquid and a gas like those used as medicaments or as standards or control fluids for gas chromatography or gas analysis or any analytical reagents.

When the fluid 12 comprises at least one gas dissolved in a liquid the types of gases can range from oxygen alone, carbon dioxide alone, or a mixture of oxygen and carbon dioxide and others such as air and various mixtures of the types of gases comprising air in varying amounts to those contained in air. Also other types of gases can be present either alone or in mixtures. These include nitrogen, carbon disulfide, carbon monoxide, methane and other similar hydrocarbon gases, and ozone, and unreactive mixtures of these gases and atmospheric gases.

Generally, a reference fluid as fluid 12 is an aqueous solution having at least one dispersed gas. This method and the solutions that are prepared generally involve the aqueous medium having one or more dissolved salts, such as alkali metal and alkaline earth metal chlorides, bromides and phosphates like common salt, NaCl, potassium chloride, ammonium chloride, lithium bromide, potassium and sodium phosphate, any water soluble bicarbonate salt such as alkaline metal and/or alkaline earth metal bicarbonates and bicarbonates in which the cation is derived from ammonia or amines and the like. Nonexclusive examples of the bicarbonate salts include lithium bicarbonate, sodium bicarbonate, potassium bicarbonate, magnesium bicarbonate, ammonium bicarbonate, dimethyl ammonium bicarbonate and the like. It is preferred to use sodium bicarbonate because it is the most economic and preferred salt. The amounts of these are those that are necessary to obtain pressures corresponding generally to those of the fluids to be analyzed. In this regard these water-soluble inorganic salts act to buffer the aqueous solution. Generally, a buffer salt is one which when added to an aqueous solution will maintain the pH not withstanding the absorption of carbon dioxide or the introduction of acids or bases.

Generally, the quantity of the gas within fluid 12 can be produced by any method known to those skilled in the art. For example, the reference fluid can be a tonometered fluid produced by any of the commercially available tonometers like the one available from Instrumentation Laboratory under the designation IL237 or by any method known to those skilled in the art like the techniques shown in preparing tonometered buffered solution or whole blood described in the article entitled "Quality Control in Blood pH and Gas Analysis by Use of a Tonometered Bicarbonate Solution and Duplicate Blood Analysis in Clinical Chemistry", Vol. 27, No. 10, 1981 pages 1761–1763, the description of which is hereby incorporated by reference. Also, the amount of dispersed gas can be prepared in such a manner to vary over a number of vials to produce a series of vials containing various concentrations of the gas. Such a series of vials can act as standards for calibrating gas measuring equipment. Most preferably, the aqueous solution is buffered and contains oxygen and carbon dioxide for use in blood gas measuring equipment as a quality control reference or as a calibrant. Such solutions can be prepared in accordance with U.S. Pat. No. 3,681,255, the description of which is hereby incorporated by reference.

In this description and in the accompanying claims, the term "equilibrating" is used in its art-recognized sense to mean that the gas and the buffer solution are maintained in contact with each other until such time as a state of equilibrium has been reached between the gas dissolved in the liquid phase and that which is undissolved. An example of an equilibrated or tonometered reference fluid as fluid 12 can result from contact of the buffered liquid solution with the carbon dioxide containing gas which can include a mixture of carbon dioxide with one or more inert gases. An inert gas is one which does not react with the buffer solution to change the pH. This would destroy the predictability of a final pH value. Also, inert gas is one that does not react with any of the ingredients in the reference fluid. Nonexclusive examples of inert gases are nitrogen, argon and other similar gases normally found in the air. This includes the noble gases such as neon, argon, krypton, xenon, helium and the like. It is preferred to use as the equilibrating gases for blood gas analysis a mixture of carbon dioxide and nitrogen or carbon dioxide with oxygen and nitrogen. Two nonexclusive examples include: (1) around 5 percent carbon dioxide with oxygen making up the balance of the gas in the fluid, and (2) around 7 volume percent carbon dioxide and around 10 volume percent oxygen and the balance is nitrogen.

The reference fluid with the controlled amount of gas or equilibrated with gas is maintained in an environment which prevents the diffusion of gas or vapor into or out of the system to prevent any drifting of the partial pressure values and any change in pH value. Art-recognized apparatus for maintaining this reference fluid can be used and one such example is the aforementioned commercial tonometer.

In addition, the fluid 12 as a reference fluid may contain one or more compounds to enhance the solubility of a particular gas in the buffered solution. Any of these compounds known to those skilled in the art can be used.

In FIG. 1, vial 10 is a glass vial having a rim 18 which circumferentially contains opening 16. The rim is substantially flat on top and is designed to provide for various types of attachments for seal 20 to cover opening 16. Although the vial can have any dimensions known to those skilled in the art for serum vials and like containers, the vial preferably has a cylindrical shape although other shaped containers can also be formed such as more rounded or bulbous shapes. The vial 10 has a neck region 14 which can be any shape to support an opening 16 for the container. The shoulders leading to the neck area 14 can be close to right angle or have a gentle slope toward the opening 16. Preferably, the vial has shoulders sufficient to define a recess at neck region 14 between the shoulders of a vial and the lowermost portion of rim 18. The vial can be made of any standard glass composition for preparing containers, and one such suitable composition is that known in the art as Type I borosilicate glass. Generally, the narrowest diameter for the one or more openings (16) in the vial 10 is that which is just effective for the addition and removal of fluid 12 to and from the vial. The largest opening is that which would still provide flange 18 with a sufficient top horizontal surface surrounding opening 16 for the seal 20 to be in peripheral contact with flange 18 to cover opening 16. Preferably, opening 16 is a central opening in vial 10 which extends along the longitudinal axis of the flange 18 and neck 14 to open into the inside central opening of the vial that contains fluid 12. More preferably, vial 10 can have dimensions that vary within the ranges of: for wall thickness from about 0.5 to about 1.5 millimeters (mm), for internal diameter about 3 to about 50 mm, and for length about 3 mm to about 200 mm. The vial can have a second opening similar or dissimilar to the aforedescribed opening at the opposing end of the cylindrical shape from the first opening. The second opening would have a seal 20 as described for the first opening.

Figure 1A:
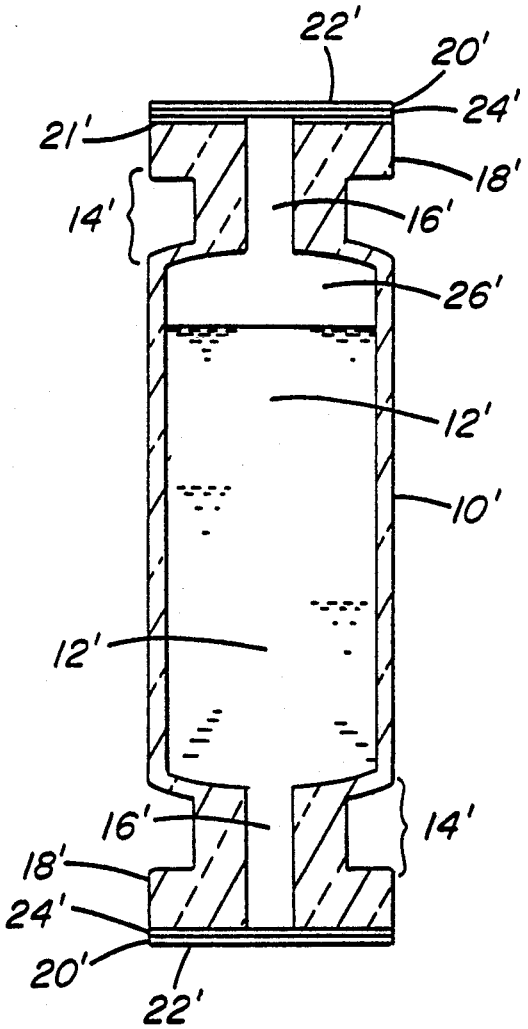
FIG. 1A depicts the cross sectional side view of the container as in FIG. 1 where the container has two openings at opposing ends each having a seal as in FIG. 1.

This is illustrated by viewing FIGS. 5 and 6 together where the end of the vial of FIG. 6 is rotated 180 degrees to the aligned with the end of the vial of FIG. 6 to form a cylindrical vial with two openings 16 that are at opposing ends of the vial as shown in FIG. 1A where the reference numbers are similar to those of FIG. 1 except denoted by a prime after the reference number.

Seal 20 in FIG. 1 is a single layer or multilayer laminate that is substantially impervious to air. A suitable single layer material includes metal foil that is capable of sealing by a polymeric material that can be heat-treated or RF (radio frequency) treated for sealing. The multilayer laminate material ordinarily has an interior layer of polymeric material and outside this layer a metal foil layer. A typical laminate can have two or more layers and may have an additional outer polymeric layer to facilitate abrasion resistance or printing on top of the metal foil layer. A nonexclusive example of the metal foil is aluminum. A three layer laminate suitable for the seal of the present invention can have from the exterior surface to the interior layer the following: (1) nylon, polyester;polyethylene or polypropylene, (2) aluminum foil, and (3) an inner heat sealable polymeric layer such as polyethylene, polypropylene, polyvinylidene chloride or nylon. A nylon-foil-polypropylene laminate of, i.e., 17 grams per square meter nylon, 32 grams per meter squared aluminum, 45 grams per meter squared polypropylene or of a suitable example is a polyfoil-polylaminate which is a three-layer composite having an aluminum foil intermediate layer and an inner and outer layer of polypropylene. The upper layer or section 22 is away from the mouth or opening 16 of the vial and a lower layer or section 24 is in contact with the glass of rim 18. Preferably, the seal 20 is a paper-backed aluminum foil coated with a clear heat sealable coating. The coating is preferably a blend of a high molecular weight ethylene and vinyl acetate copolymer, available under the trade designation "SANCAP" available from Sancap, 161 Armor Street NE, Alliance, Ohio 44601. Such materials have a gas transmission for oxygen that is nil and a water vapor transmission which ranges from 0.005 to 0.059 GS (grams)/CSI(100 square in)/24 hours at 90 percent relative humidity. Such materials provide a seal that when securely attached across the opening 16 of the vial 10 provide substantial imperviousness to air. These values are obtained on a Permatran-W6 for water transmission and an Ox-tran 1000 for oxygen transmission, and both pieces of equipment are available from Mocon, Modern Controls, Inc., 6820 Shingle Creek Parkway, Minneapolis, Minn. 55430. The thickness of the seal 20 can range from an overall thickness of around 4 to 8 mils more preferably around 4.6 to around 7.8 mils with the heat seal coating ranging in thickness from around 1 to around 4 mils and more preferably from around 1.5 to around 3 mils and the aluminum foil ranging in thickness from around 0.1 to around 2 and more preferably from around 0.3 to around 1.65 mils.

Alternatively, seal 20 has the adhesive material 24, which is a thermoplastic resin suitable for hot melt deposition or extrusion lamination. Suitable examples of these thermoplastic resins include resins known as the so-called hot-melt type adhesive, such as polyethylene, an ethylene/vinyl acetate copolymer (EVA) or a partially saponified EVA. For instance, a graft copolymer can be used that is a 20 to 60 percent saponification product of an ethylene/vinyl acetate copolymer (EVA) having a vinyl acetate content of 15 to 45 percent by weight as a trunk polymer and a polymer of an unsaturated carboxylated acid in a quantity of 0.1 to 10 percent by weight of the partially saponified EVA as a branch polymer. Also, the seal 20 can be a composite of an aluminum/polypropylene film with a heat sealable resin such as a polyamide, polyolefin, and saturated polyesters. When sealing to adhere the resin to the glass surface and thereby adhere the seal to vial 10 is performed by heat sealing, any induction sealing or any heat sealing method known to those skilled in the art can be used. The method of sealing depends to a degree on the securing means used to maintain the seal 20 in a snug relationship to the flat surface of rim 18. The seal 20 can have any shape suitable for covering completely opening 16 and providing for a snug fitting with the flat surface of rim 18. Preferably, the seal is in the form of a disc having a diameter similar to the diameter of the rim 18.

Generally, in FIG. 1 the reference fluid 12 does not completely fill the vial 10 to produce a head space 26. When the fluid 12 is a liquid medicament present in the vial that has a snap cap, a head space need not be present although one could be present and occupied by an inert gas over the liquid medicament. Generally, the head space 26 is occupied by a vacuum or inert gases or one or more gases that are similar to or dissimilar from the gas or gases dissolve in fluid 12. Preferably, the head space 26 is occupied by the equilibrium gases that are dissolved in fluid 12 in the case of blood gas measurement applications.

A nonexclusive example of a suitable process for placing the requisite quantity of reference fluid 12 in vial 10, purging the head space 26 with the requisite composition of gas, placing seal 20 on the flat surface of rim 18, and securely attaching seal 20 to rim 18 in FIG. 1 occurs in the following manner. A vial 10 of FIG. 1 with the seal 20 in place over opening 16 is held with the application of pressure against a region where it is exposed to high-frequency electromagnetic waves. A suitable piece of equipment is that available from Giltron Inc., Medfield, Mass. 02052, referred to as Foil Sealer Induction Heat Sealer, Model PM1. The aluminum foil of the seal 20 is locally heated to a point whereby it heats and melts the adjacent adhesive layer. The melted resin layer adheres to the top horizontal surface of rim 18 that surrounds the opening 16. Use of conventional capping machines to perform such an induction sealing process could produce approximately 200 seals per minute in high-speed operation. Also, an enhanced securing of the seal 20 to the rim 18 can be achieve through the use of a coupling chemical agent present on the glass surface at rim 18. Suitable nonexclusive examples of such coupling agents are the organosilanes such as vinyltriethoxysilane, gamma-glycidoxypropyl trimethoxysilane or an organo-titanate such as tetrapropyltitanate or tetrabutyltitanate.

When the fluid 12 has oxygen gas dissolved in it or the head space 26 has oxygen gas and the measurement or concentration of the oxygen in vial 10 is important, the diameter of the opening 16 is controlled. By "controlled", it is meant that the diameter of the opening is maintained at a minimum to limit the surface area of the laminate that is exposed to the components of the head space 26 and/or fluid 12. This limits any possible reactivity between the oxygen in the head space 26 and/or fluid 12 with the metal and/or adhesive polymer of the laminate.

Figure 2:
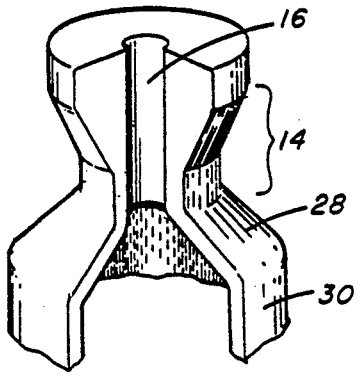
FIGS. 2 and 3 depict the container useful with the screw cap or closure securing the seal to the glass vial.

FIG. 2 shows an alternate shape of the neck 14 for vial 10. The neck region can have any shape to allow for an opening from the vial 10. FIG. 2 shows a different shape than that of FIG. 1 where the shoulders 28 of vial 10 have a greater slope from the neck region 14 to the body region of vial 10 where the body is indicated as numeral 30. Such a vial is preferred when a snap cap is applied to it to secure the seal 20 over opening 16 as shown is FIG. 4.

Figure 3:
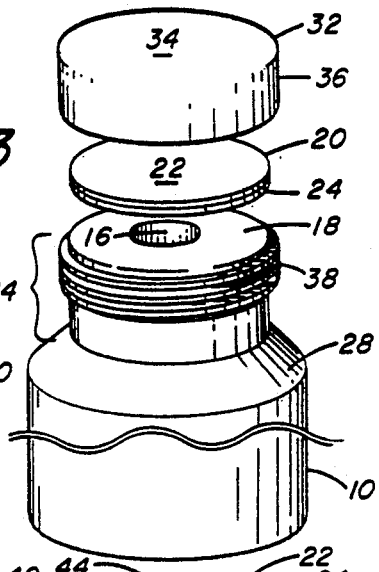

Snug fitting of the seal 20 to the rim 18 can be provided by a screw cap 32 as shown in FIG. 3. Similar numerals used in the different figure show the same feature from figure to figure. With such a snug fit, the container may undergo heat sealing that is sufficient to melt the thermoplastic polymer to cause the adhesion of the thermoplastic polymer to the glass to cause the seal. In FIG. 3 cap 32 can be of any conventional material, either metal or plastic, in any suitable shape. Most desirably, a rigid plastic such as polyesterlike polyethyleneterephthalate or polycarbonate or blends or alloys thereof are used. The cap 32 has a top wall 34 and an internally threaded downwardly depending side wall 36 (shown in FIG. 3 as the external side wall). The internal diameter of cap 32 is slightly greater than the external diameter of rim 18 surrounding opening 16 allowing for a snug fit of cap 32 on to the neck region 14. The vial 10 has the neck region 14 having the opening 16 at the upper end. Around the external periphery of neck 14 there is the matching fasten means to the fastening means threads within cap 32. This fastening means is the external thread 38 that along with the thread within cap 32 allows the cap to be torqued or screwed onto the neck region 14 of vial 10.

The seal 20 having the gas impermeable metal foil upper layer 22 and the thermoplastic adhesive polymer heat sealing lower layer 24 has a diameter slightly less than the internal diameter of cap 32 so that the cap can carry the seal or so that the cap fits over the seal with a snug fit to place the seal over opening 16 and onto the flat surface of rim 18. The torque sufficient to supply the snug fit of the seal to the glass vial 10 so that heat sealing rather than induction sealing can be used is generally an effective force so that not too much torque is applied to avoid breakage of any part of glass vial 10. The torque must be sufficient to have the seal snugly fit the glass rim so the opening is covered to prevent any gas in the head space or vacuum in the head space or liquid from escaping the vial. The screw cap may or may not have an aperture having a diameter sufficient to correspond to the diameter of the opening of the vial or somewhat larger or smaller to allow entrance through seal 20 to opening 16. It is possible to ameliorate the importance of the torque in screwing on the screw cap 32 through utilization of an elastomeric gasket between the cap 32 and the seal 22. Such a gasket is not shown in FIG. 3 but would be similar to that shown for the cap of FIG. 5.

Figure 4:
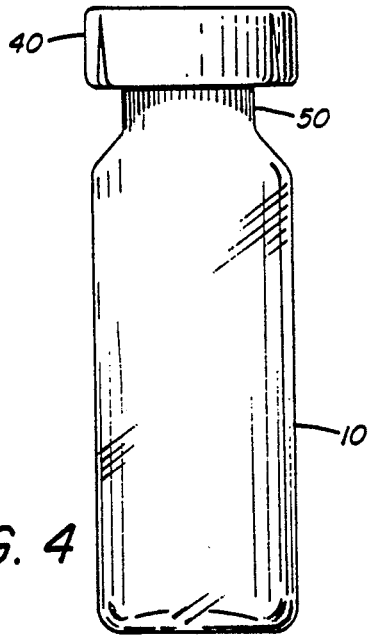
FIG. 4 depicts a somewhat enlarged side view of the container with a snap cap securing the seal to the glass vial.

FIGS. 4, 5, 6 and 7 depict the preferred embodiment of the present invention having the glass vial 10 with a snap plastic cap. Here again, in referring to the details of the drawings, like parts are designated by like reference numerals throughout all of the figures. Generally, the glass vial 10 has the dimensions of 1 to 2 inches in length and $\frac{1}{4}$ to $\frac{1}{2}$ inch in diameter. Preferably, the vial has the greater sloping shoulders as mentioned above for FIG. 2 so that the vial can endure the forces placed on it in machine capping of the snap cap. The cap here in FIG. 4 depicted as a snap cap 40 is placed in snug relationship to the rim 18 of the vial.

FIG. 5 shows this in a cut-away cross sectional view. This snug relationship is provided by cap 40 positioned above rim 18. On rim 18 and covering opening 16 is seal 20 having the two layers, the upper aluminum layer 22 and the lower layer of thermoplastic resin 24. Between the uppermost portion of snap cap 40 and the aluminum layer of the seal is elastomeric gasket 42. This gasket can have an outer diameter sufficient to allow for placement of the snap cap on the vial 10 without damaging seal 20. Preferably, the outer diameter is of the same general dimensions as those of the inner diameter of cap 40. The gasket preferably has an aperture 46 which preferably corresponds in dimensions to the aperture 44 of snap cap 40. Although the dimensions of aperture 46 can vary as long as the gasket still provides a damping, cushioning or shock absorbing effect when snap cap 40 is placed on the vial so seal 20 remains intact on glass vial 10. Preferably, the gasket is capable of withstanding compression forces of around 7 to around 14 kilograms/square centimeter. The aperture 44 of snap cap 40 can also vary in diameter. At a minimum the diameter should allow for withdrawing of fluid 12 from vial 10 with a narrow or small gauge needle. At a maximum, the diameter should provide for a minimum top surface 34 so that cap 40 can be placed on vial 10 and hold the seal snuggly to the top surface of rim 18 The snug fit is provided by a fastening means 48 on cap 40 to fit the fastening means on the vial 10. The appropriately matching fastening means on vial 10 is recess 50 that is just below the bottom most portion of rim 18. Fastening means 48 is a ring-type projection on the interior surface of the skirt of cap 40. The ring-type projection 48 and the recess 50 are preferably continuous around their respective surfaces although they can also be intermittent about their respective surfaces. In the latter case, the projection and the recess segments must be of sufficient mass and must match each other to a degree to provide a secure attachment of the cap 40 to vial 10. In general, any suitable fastening means can be used such that an annular groove could exist on the interior surface of the skirt of cap 40 and the peripheral surface of rim 18 could have an annular projecting bead to fit into the groove of cap 40. The snap cap feature of cap 40 with the projection 48 is preferred since it is more economical to produce the cap with the projection than it would be to produce the glass vial with the projection.

FIG. 6 shows a plastic snap cap similar to that of FIG. 5 without the presence of gasket 42. In this alternative embodiment of the present invention, the similar numeral references to those of FIG. 5 are for the same components. The opening 44 of the cap 40 is larger than that depicted in FIG. 5. This shows the flexibility of size of the opening 44 in cap 40. This variation can occur with or without the presence of the gasket.

Figure 7:
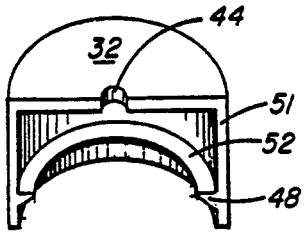
FIG. 7 is a perspective cross sectional view of the snap cap top of the container of FIGS. 4, 5 and 6.

FIG. 7 shows a cross sectional cut-away view of snap cap 40 with top surface 32 and a portion of aperture 44 and a portion of the annular ring 48. A mirror image portion exists for that section of the snap cap not shown in FIG. 7 because of the cut-away view. To get the snug fit on vial 10, the distance from the interior surface of top 32 where the interior surface is 50 to the top surface of the annular ring 52 is just slightly greater than the height of bead 18 shown in FIGS. 5 and 6 from the top surface of rim 18 shown as 54 to the bottom surface of the annular rim 18 shown as 56 in FIGS. 5 and 6, which is at the top most portion of the recess 50.

As indicated in FIGS. 1, 5 and 6, the volume of head space 26 present in vial 10 and the composition of that head space depend on several factors. These include the desired shelf life for the fluid, the need for and type of sterilization, the type of gas and concentration of gas within the reference fluid and whether the fluid is used as reference fluid for controls or for calibrating fluid for a blood gas measuring device or if the fluid is a medicine or medication and the head space is an inert atmosphere to the fluid.

When it is desired that the shelf life be minimal for use as reference fluids in the range of up to four days, the head space can have a minimal volume within vial 10. In this instance the head space can be on the order of around 10 volume percent of the internal volume of vial 10 while the reference fluid 12 can be upwards of 90 volume percent. For longer shelf life periods ranging from around six months to a year or more, the volume percent of the head space is increased. The increase is upwards to around 90 volume percent while the volume percent of the reference fluid is around 10 of the internal volume of vial 10. Preferably, for a shelf life of around six months, the volume percent of the head space is in the range of around 70 to 80 volume percent while the reference fluid 12 has a volume percent in the range of 20 to 30.

The composition of the gas in the reference fluid 12 also effects the amount of head space in that when only carbon dioxide is present in the reference fluid the head space can be minimal. While when oxygen is present either alone or in a mixture with other gases in the reference fluid 12 and when a constant oxygen tension is to be maintained in the vial for its desired shelf life, the volume percent of the head space should be maximized. If the volume percent of reference fluid 12 is too great or conversely if the volume percent or the head space is too small, the oxygen tension over a period of time will decrease.

Generally, the composition of the head space can range from a vacuum for certain applications to inert gases or gases common to the fluid for other applications. The vacuum can be produced by any artrecognized method. The composition can be an inert gas, such as nitrogen, which purges the vial after the addition of the fluid 12. Additionally, the composition of the head space can be the gas or a mixture of the gases dissolved in the reference fluid; for instance, when oxygen is dissolved in the reference fluid oxygen can be the gas in the head space and when a mixture of gases are dissolved in the reference fluid, for instance, oxygen and carbon dioxide, the composition of the head space can be the mixture of oxygen and carbon dioxide.

The concentration of the gases in the head space 26 can vary depending on the concentrations in fluid 12 and also the various treatments for the vial. For instance, when the vial undergoes sterilization by gamma-radiation, initial oxygen concentrations can be altered for certain types of fluid compositions. The gas composition of the head space can buffer any reduction in oxygen in the vial because of the type of sterilization, i.e., gamma-sterilization or any other oxygen consumption mechanism. Compensating amounts of oxygen can be present in the head space to counter this effect. For the calibrant application, the calibrant usually has an oxygen tension ranging from less than ambient to greater than ambient and a carbon dioxide tension ranging from less than ambient to greater than ambient.

Also, the type of application for the fluid in the vial can result in other factors that effect the volume of the head space. For example, when the fluid is a reference fluid for control applications or for calibrant applications, fluids with different gas concentrations can occupy separate vials to form a series of vials with each having different gas concentrations. Also, it is possible to add any of the preservatives known to those skilled in the art to the reference fluid 12. Also, for the controls application it is desirable to have a fairly constant gas tension through the period of use of a vial which can be on the order of several minutes once the vial is opened. For this reason the head space should be minimized while the opening 16 of the vial 10 should also be minimized. For calibrant applications where there is a possibility that the vial and/or calibrant may contact the patient, the vial and its contents should be sterile. Sterilization can occur by heat pasteurization and/or gamma-sterilization. Gamma-sterilization of vials with fluids having oxygen gas tends to alter the oxygen tension of those fluids. When this type of sterilization is used, the volume percent of head space and its composition should be altered accordingly.

Depending on the application, a relationship can exist between the volume percent of the head space 26 and that of the fluid 12 and the dimensions of the opening 16 in the vial. As the opening of the vial increases, the flat top surface of the annular rim 18 decreases and a sufficient flat surface must exist for contact of the seal to achieve the appropriate seal for appropriate treatments of the vial, for instance, induction sealing or heat sealing, and the type of sterilization, if performed.

Also, a problem was discovered in sealing the vial that the oxygen tension decreased over time even though the carbon dioxide tension and pH remain constant. Utilization of the head space with the proper concentration of gases occupying the head space assists in providing for a constant oxygen tension over a desired period of time. These actions along with minimizing the diameter of the opening of the vial has provided for a constant oxygen tension at least as long as eight months.

The partial pressures of the gas in the head space can be predetermined by well-known physico-chemical principles and/or empirical methods due to gas solubility effects. This involves a given head space, temperature and concentration of commercially blended gas that are bubbled until an equilibrium state is achieved. Subsequent testing of a sufficient number of samples is conducted to give a statistical profile of the partial pressures.

In filling the vials prior to sealing, the vials can be purged at least once with gas, for instance, inert gas. Preferably, for blood gas applications the purge gas has the same composition as that used to produce the reference or calibrant fluid 12. The fluid 12 is placed in the vial 10, by any manner known to those skilled in the art, but preferably from a storage area that prepares the desired amount of gas dissolved in the fluid. The vials are filled with the fluid 12 in a manner to leave some room for the head space 26. The head space 26 is purged with the desired gas usually by a narrow gauge needle that enters the vial opening 16 and applies a blanket of purge gas to the head space 26 prior to placement of seal 20 on vial 10. With the purge of the head space 26, the vial 10 is quickly sealed by induction sealing with seal 20 alone or by capping the seal 20 to the vial 10 to apply a snug fit to retard the escape of gas and fluid.

The sealing of seal 20 to vial 10 at the top and essentially flat portion 54 in FIGS. 5 and 6 depends on the presence or absence of the cap and the type of thermoplastic adhesive polymer 24. When the cap is absent, induction sealing should be used to avoid escape of gas from or the influx of gas into the head space 26 and fluid 12. When the screw cap or snap cap is used, induction sealing can be used but it is preferred to use heat sealing. With the use of heat sealing when the caps are screw caps, the proper torque of the screw cap should be applied. In general, the sealing needs to overcome the hurdle of adhering the thermoplastic adhesive polymer 24 to glass in a possibly moist environment since there may be moisture or liquid on the surface 54 of rim 18.

When the screw or snap cap is used, the seal 20 can be placed in the cap and the cap applied to a vial containing the fluid 12 and head space 26. In this instance it is not necessary to use a coupling agent on the surface of the glass of rim 18. A conventional screw or snap capping machine known to those skilled in the art can be used. A suitable capping machine for use with the screw cap is that available from the Cozzoli Machine Company of Plainfield, N.J. Another example is that disclosed in U.S. Pat. No. 4,030,271 which discloses an apparatus that is designed to screw on or unscrew the screw caps from bottles or vials held in a standard rack or holder. Preferably, the apparatus applies the caps at least sequentially to individual vials. A nonexclusive example of an apparatus for applying snap caps is a modified screw cap machine like that available from the Cozzoli Machine Company. The modification to this machine is to substitute for the screw cap application section of the machine any apparatus known to those skilled in the art to apply a force sufficient to push down a cap sitting on top of the vial until fasteners engage to secure the cap to the vial. For instance, an air pressure ram apparatus can be used.

With the caps applied in a proper way to supply a snug fit of the seal 20 to the surface of the glass vial at rim 18, the vials are treated to complete sealing, preferably as a plurality of vials in a batch operation. A plurality of vials can be heated in any suitable oven known to those skilled in the art to the softening temperature of the thermoplastic polymer or resin that can be the adhesive material 24. Preferably, this temperature is maintained for a sufficient time for adequate flow of the polymer so that adherence of the seal 20 to the glass vial 10 occurs, if not at the elevated temperature at least when the temperature is decreased to room temperature. Most preferably, a plurality of vials are placed in an oven and heated to a temperature of 50° C. to 80° C. when the seals 20 have the SANCAP ethylene and vinylacetate copolymers. This temperature is preferably maintained for a time period generally in the range of about 1 to about 8 hours. Heating at the longer time periods in this range are not only sufficient to cause the thermoplastic polymer to flow but also are sufficient to sterilize the vials by pasteurization. Shorter time periods within this range can be used to seal the vials when other sterilization processes are used.

With the capped vials a plurality of vials can be heat or induction sealed. The heat sealing temperature and the pressure applied by the cap can vary depending on the type of heat sealable resin that is used as the adhesive material 24. In general, however, sufficient results are obtained by conducting the heat sealing at a temperature higher than the softening or melting point of the heat sealable resin and the pressure is sufficient if it doesn't cause excessive or substantial flow of heat sealable resin away from the area to be sealed. For heat sealing of a polypropylene heat sealable resin the seal pressure by the screw-type cap is in the range of 2 to 5 kilograms per centimeter squared (Kg/ squared cm) for the temperature of heat sealing in the range of 180° C. to 280° C. For a polyamide, like Nylon 12, heat sealable resin the pressure is in the range of 2 to 7 Kg/square cm for the temperature of sealing of around 200° C. to 300° C. For polytetramethylene terephthalate the seal pressure is around 2 to 7 Kg/square cm for the sealing temperature in the range of 220° C. to 320° C. The time required for heat sealing varies depending on the thickness of the heat sealable resin layer.

Generally, the heat sealing is conducted for a time sufficient to perform melting and bonding of the sealable resin, for example 0.1 to 5 seconds. The heat sealing operation can be performed in an operation comprised of one stage or two or more stages. In the latter case, the same or different temperature and pressure conditions as those aforementioned can be adopted at these stages. The formed sealed area is cooled, if necessary, under application of pressure by optional means to form a sealed area with good sealing efficiency. For instance, immediately after completion of the heat sealing operation, the heat sealed area in which the resin is still in the softened or molten state is pressed by two positively cooled press bars whereby the resin is solidified. Although any operation known to those skilled in the art to cool and harden the adhesive polymer can be used.

When the fluid 12, head space 26 and the vial 10 need to be sterilized, the sealed vial or a plurality of sealed vials can be sterilized by gamma-sterilization or pasteurization sterilization. A nonexclusive example of a pasteurization technique that can be used with the sterilizable container of the present invention is heating on or more of them at a temperature of around 70° C. for eight hours. The gamma-radiation sterilization can occur with the use of any gamma-sterilization equipment known to those skilled in the art. For pasteurization sterilization, the cooling rate should be such that the total heat history given the vials is accomplished over an adequate period of time.

The method of producing the sealed vials of the present invention involves filling the one or more vials to be less than completely full, covering the opening with a substantially air impervious seal, securing the seal to the vial, sealing a plurality of the vials, and testing the vials for leaks. The vials are filled to provide for a head space in the vial which is purged with one or more gases. For instance, when the vials are used as calibrant containers, a tonometered fluid can be prepared that has at room temperature a liquid and a gas. In this application at least the liquid has a known amount of at least one type of gas dissolved in the liquid. A glass container is filled with this fluid through its opening that ranges from that which is just effective for the addition and removal of fluids to that which is the smallest side of the container. The head space can range from about 99 to less than around 1 volume percent compared to the liquid. The opening of container having the liquid and the gas is covered with a seal that is substantially impervious for air having an inner surface and an outer surface, where the outer surface is an inert backing material such as metal foil and the inner surface is an adhesive type polymer, where said seal covers the opening of the glass container. The seal is secured to the glass container by mechanical attachment means such as a cap. A plurality of the vials have the seals sealed to the glass container means by heat or induction sealing. The heat sealing can occur in any oven known to those skilled in the art that can preferably accomodate a plurality of vials and can heat to the desired temperatures.

Quality control of the sealing of the vials can be accomplished by at least one of two methods. One method is to observe the plurality of vials for leaks by detection of any change in the fluid volume in the vials or evidence of moisture under a specific vial during heat sealing. Another method is to subject a plurality of sealed vials to a condition of reduced pressure where the vials are oriented with the seal in contact with the liquid in the vials. Preferably the vials are inverted so that the liquid in the vials contacts the seal of that particular vial. The reduced pressure need not necessarily be absolute vacuum but should approach a lower pressure around a vacuum to cause any leaks in the seal to be evident from the decrease in the volume of the liquid in the vial or the presence of moisture or weeping from the vial.

Figure 8:
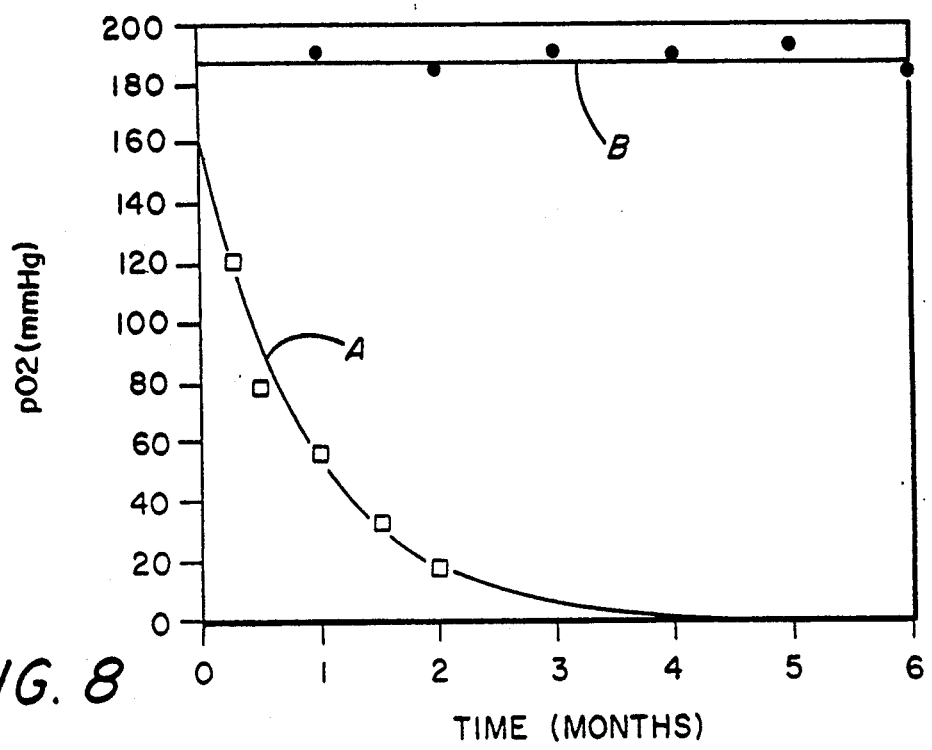
FIG. 8 is a graph of the partial pressure of oxygen in millimeters of mercury on the ordinate vs. time in months on the abscissa for two separate conditions.

FIG. 8 shows a graph of the partial pressure of oxygen (pO2) in millimeters of mercury on the ordinate vs. time in months on the abscissa for two types of vials. Both types of vials were snap cap vials like that of FIGS. 4 through 7 and like that of the below-described Example 1. The one type of vial, hereinafter referred to as "Type A" was sealed without a head space and did not have the smallest diameter opening. The Type A vial had a diameter for the opening of 4.5 mm and an area for the opening of 63.5 square mm. The pO2 for this condition is indicated by curve A. The second type of vial, hereinafter referred to as "Type B" was sealed with a head space of 54 volume percent and had an opening that was at a minimum diameter. The Type B vial had a diameter for the opening of 1.75 mm and an area for the opening of 9.6 square mm. The pO2 for this condition is indicated as curve B. Because of the difference of the areas of the opening, the surface area of the foil exposed to the internal contents of the vial varied for the vials of Types A and B. In FIG. 8 the pO2 for Curve B stays relatively constant over 6 months while that for Curve A drops from 180 to zero over around a 5 month period. This achievement of a constant oxygen gas tension over a period of six months results from the vial of the present invention having the head space and construction to maintain that head space and having the minimum diameter opening for the vial that is sealed with the aluminum foil seal with the adhesive material. The constant oxygen gas tension has even extended beyond 6 months and is currently up to 12 months.

Figure 9:
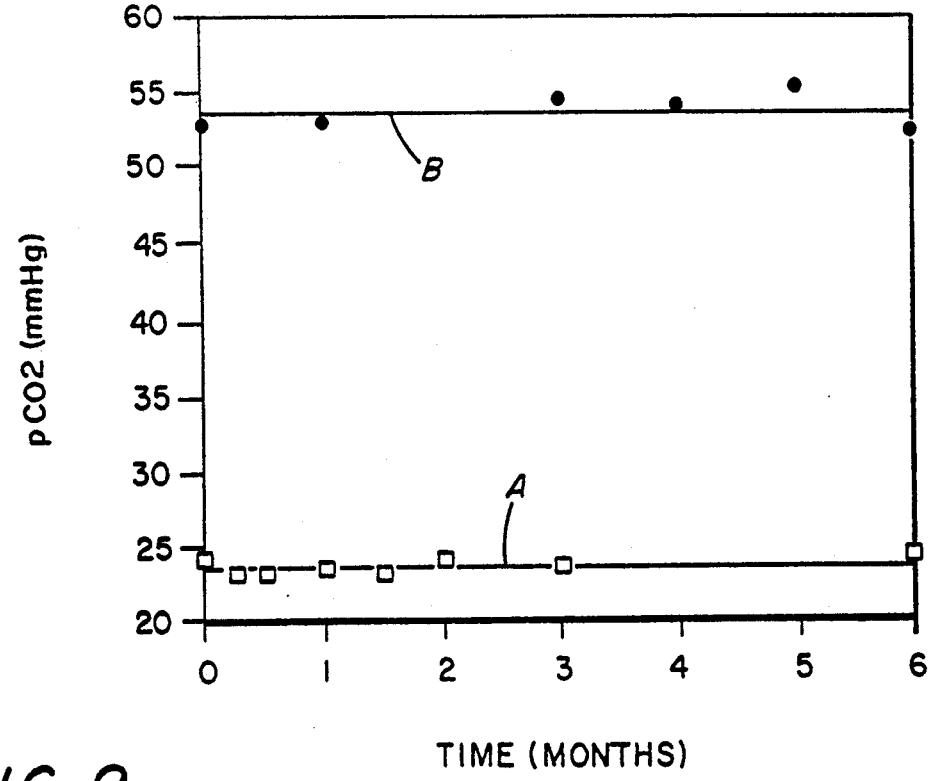
FIG. 9 is a graph of the partial pressure of carbon dioxide in millimeters of mercury on the ordinate vs. time in months on the abscissa for two separate conditions.

For FIG. 9 a plurality of the same two types of vials that were tested for FIG. 8 were tested for loss of the partial pressure of carbon dioxide (pC02) over a six month period. In addition, two different levels of (pC02) were tested along with the two types of vials. FIG. 9 shows that the pC02 at two levels is unaffected by head space and/or the difference in the diameter of the opening of the vial.

EXAMPLES

In Example 1, a vial like that of FIG. 1 was produced by purging the vial with the gas used to make the tonometered fluid and the tonometered fluid was added so as not to completely fill the vial. The vial was purged again with the same gas and the Sancap aluminum bilaminate foil was placed on the top of the vial with the aluminum foil side facing externally. The top of the vial with the foil was pushed against the external bar of a Foil Sealer Induction Heat Sealer from Giltron Inc. of Medfield, Mass., Model No. B1 with an output wattage of 775 and single phase and held there for a sufficient period for induction sealing of the foil seal to the vial.

In Example 2, the plastic snap cap of FIGS. 4 through 7 having the gasket and the seal was placed on the vial 10 top surface in such a manner that the gasket 22 is between the underside of the cap surface 32 and the top surface 18 of vial 10. The aluminum surface of the Sancap bilaminate material seal is away from the glass surface. The snap cap was placed on the vial by a pick and place attachment to a modified screw cap machine from the Cozzoli Machine Company. The modification to this machine is to substitute an air pressurized ram for the screw cap application section of the machine. The rim comes down vertically on top of the snap cap to apply a force sufficient to push the cap sitting on top of the vial until fasteners engage to secure the cap to the vial (snapped). When the cap is snapped on the vial, the gasket is under compression to apply a compressive force of between 7 Kg/square cm and 14 Kg/square cm on the bilaminate aluminum foil 20 covering the vial opening. Induction sealing or heat sealing can be used since the gasket supplies pressure to keep the seal 20 fixed against the rim of the vial prior to and during the sealing process.

We claim:

1. A hermetically-sealed container containing a liquid with at least one dissolved gas, comprising:

(a) glass container means having at least one opening at one end where the dimensions of the controlled opening ranges from that which is just effective for the addition and removal of fluids to that which is the smallest side of the container, where the opening has a diameter ranging from around 1 to around 10 millimeters for the glass container means having an internal diameter in the range of at least 3 to around 50 millimeters, and where a flange circumferentially extends about the opening where the flange ranges in thickness form the wall thickness of the container to slightly less than the radius of the container to allow for the opening.

(b) seal that is substantially impervious to air having at least two surfaces wherein the first surface is metal and the second surface is an adhesive type polymer, where said second surface of the seal contacts a sufficient surface area of the container to cover the opening to substantially eliminate the escape of gas, and (c) fluid comprised of a liquid and a gas, wherein the liquid has a known amount of gas dissolved therein where the gas is selected from (1) at least oxygen, and (2) oxygen and carbon dioxide and wherein the fluid is present in the container in an amount to make the container less than completely full to provide a head space where the volume percent of the liquid compared to the head space ranges from about 99 to less than around 1.

2. The container of claim 1 wherein the substantially impervious seal is also impervious to oxygen and carbon dioxide, and wherein the fluid is a tonometered reference fluid having a concentration of oxygen and carbon dioxide at a partial pressure of oxygen in the range of 0 to 760 millimeters of mercury and a partial pressure of carbon dioxide in the range of 0 to 760 millimeters of mercury.

3. Container of claim 1 that has a cylindrical shape.

4. Container of claim 1 wherein the volume percent of the head space compared to the liquid ranges from around 77 to around 23 volume percent.

5. Container of claim 1 wherein the head space is occupied by an atmosphere of an inert gas.

6. Container of claim 1 wherein the head space is occupied by an atmosphere of gas selected from the group consisting of: oxygen, carbon dioxide and mixtures thereof and with mixtures of one or more inert gases.

7. Container of claim 6 wherein the concentration of oxygen ranges from less than ambient to greater than ambient and the concentration of carbon dioxide ranges from less than ambient to greater than ambient.

8. Container of claim 2 wherein with the presence of oxygen in the fluid the container has the opening with a controlled diameter that is in the lower portion of the range of opening dimensions to limit the exposure of the surface area of the seal to the fluid.

9. Container of claim 1 wherein the liquid has been equilibrated with a gas mixture containing carbon dioxide, oxygen, and an inert gas and the headspace is occupied by the same gas used to prepare the equilibrated liquid.

10. Container of claim 1 wherein the liquid is an aqueous solution having one or more dissolved salts selected from the group consisting of: alkali meal and alkaline earth metal chlorides, bromides and phosphates like sodium chloride; potassium chloride; ammonium chloride; lithium bromide; potassium, and sodium phosphate; any water soluble bicarbonate salt which includes alkaline metal and/or alkaline earth metal bicarbonates and bicarbonates where the cation is derived from ammonia or amines and the like which includes the bicarbonates salts including lithium bicarbonate, sodium bicarbonate, potassium bicarbonate, magnesium bicarbonate, ammonium bicarbonate, dimethyl ammonium bicarbonate; and other buffer salts to buffer the aqueous solution to maintain the pH not withstanding the absorption of carbon dioxide or the introduction of acids of bases where the salts are present in effective amounts to obtain suitable pressures so that the fluid can be equilibrated with at least one gas.

11. Container of claim 1 wherein the head space is occupied by a atmosphere of gas selected from the group consisting of: nitrogen, carbon disulfide, carbon monoxide, methane and other hydrocarbon gases ,and ozone and unreactive mixtures thereof.

12. Container of claim 1 wherein the seal is a layer of adhesive polymer that is a high molecular weight ethylene and vinyl acetate copolymer.

13. Container of claim 1 wherein the surface of the flange of the glass has a coupling chemical agent treatment to enhance the affiliation of the seal to the glass container means.

14. Container of claim 1, which includes a cap securing the seal to the glass container means and associated with the glass container means through a fastening member on the cap and a counterpart fastening member on the glass container where these members interact so that when the cap closes on the glass container in a secure manner the seal is secured to the glass container means to reduce the amount of any fluid leaving the container.

15. Container of claim 14 wherein the cap has fastening members that are matching threads present as one set on the internal surface of the cap and the matching set is present on the peripheral side of the flange of the glass container means.

16. Container of claim 14 wherein the cap has fastening members that provide a catch to secure the cap to the glass container means.

17. Container of claim 14 wherein the cap is a plastic snap cap having one fastening member on the cap that is at least an intermittent bead and the matching member on the glass container means is the end of the flange along the vertical dimension of the glass container means that is a relief at least intermittently along the circumferential dimension around the glass container means.

18. Container of claim 17 wherein the plastic snap cap has an aperture through the top surface aligned with the opening of the glass container for removal of the fluid from the container.

19. Container of claim 17 wherein the plastic cap is a rigid polymer.

20. Container of claim 17 wherein the plastic cap is a rigid polymer selected from the group consisting of polycarbonate, thermoplastic polyester, polyacrylates, and blends and alloys thereof.

21. Container of claim 17 which includes a disc-like gasket inside the plastic snap cap to cushion the contact between the snap cap and the seal when the cap is placed on the container and the seal covers the opening of the container.

22. Container of claim 1 wherein the glass container means is cylindrical and has an opening with seals at both opposing ends of the cylinder.

23. A hermetically-sealed container containing a liquid for calibration and/or quality control in blood gas measuring devices, comprising:

(a) glass container means having at least one opening with a diameter in the lower regime of the range of that which is just effective for the addition and removal of fluids to that which is the smallest side of the container, where the opening has a diameter ranging from around 1 to around 10 millimeters for the glass container means having an internal diameter in the range of at least 3 to around 50 millimeters, and where a flange circumferentially extends about the opening where the flange ranges in thickness from the wall thickness of the container to slightly less than the radius of the container to allow for the opening, (b) seal that is substantially impervious to air having at least two surfaces where the first surface is an inert backing material which can include metal foil selected from aluminum and copper and the second surface is an adhesive type polymer selected from the group consisting of: heat activated adhesive, pressure sensitive adhesive, and induction sealing adhesive, where said second surface of the seal contacts a sufficient surface area of the container to cover the opening to substantially eliminate the escape of gas.

(c) cap securing the seal to the glass container mean sand associated with the glass container means through a fastening member on the cap and a counterpart fastening member on the glass container where these members interact so that when the cap closes on the glass container in a secure manner the seal is secured to the glass container means to reduce the amount of any fluid leaving the container, wherein when the cap is a plastic snap cap of a moldable rigid polymer there can be an aperture through its top wall and with one fastening member associated with the cap that is at least an intermittent bead circumferentially along the inside vertical portion of the cap and with the matching fastening member on the glass container means that is associated with the flange somewhere along the vertical dimension of the glass container means that is a relief at least intermittently along the circumferential dimension around the glass container means and there is included a gasket that has the dimensions to associate with the inside of the cap between the top inside surface of the cap and the seal, and (d) fluid comprised at room temperature of a liquid and a gas, where at least the liquid has a known amount of gas dissolved therein where the gas is selected from (1) at least oxygen, and (2) oxygen and carbon dioxide and wherein the fluid is present in the container, to have the container less than completely full to provide a head space where the volume percent of the liquid compared to the head space ranges from about 99 to less than around 1, and wherein the diameter of the opening of the container in the lower regime limits the exposure of the surface area of the seal to oxygen in the container.

24. Container of claim 23 wherein the matching fasteners are the external threads downwardly depending on the circular side wall of the glass container and the cap having an internal threads downwardly depending on the caps circular side wall.

25. Container of claim 23 wherein the seal is flexible generally circular disc having a generally circular periphery and a diameter circumferentially seals the opening of the glass container means.

26. A hermetically-sealed container containing a liquid for calibration and/or quality control in blood gas measuring devices, comprising:

(a) glass container means having at least one opening with a diameter in the lower regime of the range of that which is just effective for the addition and removal of fluids to that which is the smallest side of the container, where the opening has a diameter ranging from around 1 to around 10 millimeters for the glass container means having an internal diameter in the range of at least 3 to around 50 millimeters, and where a flange circumferentially extends about the opening where the flange ranges in thickness from the wall thickness of the container to slightly less than the radius of the container to allow for the opening, (b) seal that is substantially impervious to air having at least two surfaces where the first surface is an inert backing material which can include metal foil selected from aluminum and copper and the second surface is an adhesive type polymer selected from the group consisting of: heat activated adhesive, pressure sensitive adhesive, and induction sealing adhesive, where said second surface of the seal contacts a sufficient surface area of the container to cover the opening to substantially eliminate the escape of gas.

(c) cap securing the seal to the glass container mean sand associated with the glass container means through a fastening member on the cap and a counterpart fastening member on the glass container where these members interact so that when the cap closes on the glass container in a secure manner the seal is secured to the glass container means to reduce the amount of any fluid leaving the container, wherein when the cap is a plastic snap cap of a moldable rigid polymer there can be an aperture through its top wall and with one fastening member associated with the cap that is at least an intermittent bead circumferentially along the inside vertical portion of the cap and with the matching fastening member on the glass container means that is associated with the flange somewhere along the vertical dimension of the glass container means that is a relief at least intermittently along the circumferential dimension around the glass container means and there is included a gasket that has the dimensions to associate with the inside of the cap between the top inside surface of the cap and the seal, wherein the cap's aperture is a central aperture and the cap has an annular skirt with an inner peripheral ring with a chambered lower portion a distance from the flat top to clasp under the flange that ends in a relief on the glass container; and (d) fluid comprised at room temperature of a liquid and a gas, where at least the liquid has a known amount of gas dissolved therein when placed in the container, to have the container less than completely full to provide a head space where the volume percent of the liquid compared to the head space ranges from about 99 to less than around 1, and wherein when oxygen is one of the gases dissolved in a known amount in the liquid the diameter of the opening of the container is in the lower regime of the range to limit the exposure of the surface area of the seal to oxygen in the container.

27. Container of claim 23 wherein the plastic cap has a top wall and an internally threaded downwardly depending circular side wall.

28. The container of claim 23 wherein the glass container means has a cylindrical shape and the substantially impervious seal is also impervious to oxygen and carbon dioxide, and wherein the fluid is a tonometered reference fluid having a concentration of atmospheric gas selected from at least oxygen and oxygen and carbon dioxide at a partial pressure of oxygen in the range of 0 to 760 millimeters of mercury and a partial pressure of carbon dioxide in the range of 0 to 760 millimeters of mercury.

29. Container of claim 23 wherein the volume percent of the head space compared to the liquid ranges from around 77 to around 23 volume percent.

30. Container of claim 23 wherein the head space is occupied by an atmosphere of an inert gas.

31. Container of claim 23 wherein the head space is occupied by an atmosphere of gas selected from the group consisting of: oxygen, carbon dioxide and mixtures thereof and with mixtures of one or more inert gases.

32. Container of claim 31 wherein the concentration of oxygen ranges from less than ambient to greater than ambient and the concentration of carbon dioxide ranges form less than ambient to greater than ambient.

33. Container of claim 23 wherein the liquid has been equilibrated with a gas mixture containing carbon dioxide, oxygen, and an inert gas and the headspace is occupied by the same gas used to prepare the equilibrated liquid and the gas is selected from the group consisting of: oxygen, carbon dioxide and inert gas and mixtures thereof.

34. Container of claim 23 wherein the liquid is an aqueous solution having one or more dissolved salts selected from the group consisting of: alkali metal and alkaline earth metal chlorides, bromides and phosphates like sodium chloride; potassium chloride; ammonium chloride; lithium bromide; potassium and sodium phosphate; an water soluble bicarbonate salt such as alkaline metal and/or alkaline earth metal bicarbonates and bicarbonates and those where the cation derived from ammonia or amines and the like such as the bicarbonates salts including lithium bicarbonate, sodium bicarbonate, potassium bicarbonate, magnesium bicarbonate, ammonium bicarbonate, dimethyl ammonium bicarbonate; and other buffer salts to buffer the aqueous solution to maintain the pH not withstanding the absorption of carbon dioxide or the introduction of acids or bases where the salts are present in effective amounts to obtain suitable pressures so that the fluid can be equilibrated with at least one gas.

35. Container of claim 23 wherein the head space is occupied by a atmosphere of gas selected from the group consisting of: nitrogen carbon disulfide, carbon monoxide, methane and other hydrocarbon gases and ozone and unreactive mixtures thereof.

36. Container of claim 1 wherein the first surface of the seal is a metal foil selected from aluminum and copper and the second surface is an adhesive type polymer selected from the group consisting of: heat activated adhesive, and induction sealing adhesive.

37. Container of claim 1 wherein the seal is pierceable.

38. Container of claim 23 wherein the seal is pierceable.

* * * * *

UNITED STATES PATENT AND TRADEMARK OFFICE

CERTIFICATE OF CORRECTION

PATENT NO. : 5,230,427

DATED : July 27, 1993

INVENTOR(S) : Betts, et al.

It is certified that error appears in the above-indentified patent and that said Letters Patent is hereby corrected as shown below:

At column 14, Claim 1, line 65, "dimensions" should be --dimension--.

At column 15, Claim 1, line 6, "form" should be --from--.

At column 17, Claim 23, lines 23-24, "mean sand" should be --means and--.

At column 18, Claim 25, lines 29-30, "mean sand" should be --means and--.

At column 19, Claim 32, line 27, "form" should be --from--.

At column 20, Claim 34, line 7, "an" should be --any--.

Signed and Sealed this

Sixteenth Day of August, 1994

*Attest:*

Bruce Lehman

BRUCE LEHMAN

*Attesting Officer*

*Commissioner of Patents and Trademarks*